United States Patent [19]

Sika et al.

[11] 4,276,832

[45] Jul. 7, 1981

[54] TRANSPORTATION DEVICE WITH AN ELECTRODYNAMIC SUSPENSION

[76] Inventors: Zigurd K. Sika, ulitsa A. Eremenko, 9, kv. 40; Voldemar V. Apsit, ulitsa Lenina, 66, kv. 22; Khubert L. Daugulis, ulitsa Blaumanya, 12-a, kv. 5; Ivan I. Kurkalov, ulitsa Tilta, 11/5, kv. 14, all of Riga, U.S.S.R.

[21] Appl. No.: 968,869

[22] Filed: Dec. 12, 1978

[30] Foreign Application Priority Data

[SU] U.S.S.R. .....

[51] Int. Cl.[3] ..... B61B 13/08

[52] U.S. Cl. ..... 104/292

[58] Field of Search ..... 104/148 MS, 148 LM, 104/282, 287, 288, 292, 298

[56] References Cited

U.S. PATENT DOCUMENTS

| | | | |
|---|---|---|---|
| 3,927,620 | 12/1975 | Clapham | 104/292 |
| 3,960,090 | 6/1976 | Maki et al. | 104/292 |
| 4,015,540 | 4/1977 | Roxberry | 104/292 |
| 4,055,123 | 10/1977 | Heidelberg | 104/292 |

*Primary Examiner*—Richard A. Bertsch

*Attorney, Agent, or Firm*—Fleit & Jacobson

[57] ABSTRACT

A transportation device with an electrodynamic suspension comprises a motor system, a suspension system, and a transverse stabilization system, the systems being provided with field coils of the motor, levitation and transverse stabilization, arranged on a vehicle, and a single-layer three-phase armature winding mounted horizontally along a track bed. The armature winding consists of active portions of turns formed as plates up to one third of the pole pitch of the armature winding in width, and end portions formed in two layers and made as rectangular plates mounted parallel to the track axis. The end portions of the three-phase armature winding are used as reactive buses or conveyors of transverse stabilization. At least one layer of the end portions is mounted parallel to the planes of the field coils of transverse stabilization.

13 Claims, 14 Drawing Figures

TRANSPORTATION DEVICE WITH AN ELECTRODYNAMIC SUSPENSION

FIELD OF THE INVENTION

The present invention relates to transportation engineering, and more particularly to transportation devices with an electrodynamic suspension.

The invention can be most advantageously used in high speed land transportation systems with vehicle running speeds of over 350 kms/hr.

BACKGROUND OF THE INVENTION

It has been known various devices for high speed land transportation, employing electomagnetic or electrodynamic vehicle suspension (levitation) and propulsion by a linear synchronous or linear asynchronous motor and having a system of transverse stabilization.

Transportation devices with an electrodynamic suspension and linear synchronous motors are the most promising ones. The advantages of the transportation devices with an electrodynamic suspension and linear synchronous motors, as compared to other constructions of high speed land transportation systems, are: firstly, a high levitation clearance determined by a large distance of exciting coils mounted on the vehicle of a transportation device to a track bed and ranging from 10 to 30 cm, while in the transportation devices with an electromagnetic suspension it ranges from I to 3 cm, and secondly, no need to supply electric current to the vehicle. It should be noted that the problem of electric current supply to a linear synchronous motor mounted on the vehicle with running speeds of over 350 kms/hr is not definitely solved up to now.

There are known transportation devices with an electrodynamic suspension and linear synchronous motors, including three self-contained systems:

- the system of a linear synchronous motor, comprising alternate pole systems of field coils arranged on the vehicle, and multiphase armature windings mounted on the track bed;
- the system of an electrodynamic suspension, comprising field coils arranged on the vehicle and reactive buses or conveyors mounted on the track bed and formed as metal strips; and
- the system of transverse stabilization of the vehicle, comprising field coils arranged on the vehicle, and reactive buses or conveyors mounted on the track bed, formed by elements installed in succession along the track bed as short circuits in the form of a figure-eight (cf. a paper "Canadian Devolpment in Superconducting magnet and Linear Synchronous motors"; in *Cryogenics*, July 1975).

There are some other ways of forming individual systems of transportation devices with an electrodynamic suspension and linear synchronous motors, and specifically, forming the reactive bus or conveyor of a suspension system as a number of short circuits, employing vertically mounted metal strips as the reactive buses of the system of transverse stabilization, etc.

In the systems of transverse stabilization, mentioned above, the field coils either may be located on one side of each reactive bus, i.e. the system is constructed according to so called normal flux scheme, or may surround the reactive buses on both sides thereof. In the second case, the coils surrounding the reactive bus on both sides thereof are electrically connected in opposition, and the reactive buses, when the vehicle is symmetric relative to the track bed, lie in the neutral field of the magnetic fluxes of the opposite connected field coils, i.e. the system of transverse stabilization is constructed according to a zero flux scheme.

The main disadvantage of such transportion devices is a complex construction of the track structure due to three self-contained systems each of them requiring mounting of its own elements on the track bed. Furthermore, mounting of every additional system on long length tracks increases considerably its cost.

The aforementioned disadvantages of transportation devices with an electrodynamic suspension and linear synchronous motors are partly overcome by combining the systems of a linear synchronous motor and transverse stabilization, of an electrodynamic suspension and transverse stabilization, or of a linear synchronous motor and an electrodynamic suspension.

There are known transportation devices in which the propulsion system and the system of transverse stabilization are combined, and which include two parallel alternate pole excitation systems arranged along the bottom of the vehicle and two parallel armature windings and short circuits, mounted horizontally along the track bed. Said short circuits are formed by electrical connection of equipotential points of the parallel armature windings. The short circuits are simultaneously traversed by magnetic fluxes directed upwards and downwards from the field coils of alternate polarities, mounted nearby in a transverse direction (Federal Republic of Germany Pat. No. 2,607,261).

The aggregate of these circuits forms the reactive bus or conveyor for the system of vehicle transverse stabilization.

It has been known to provide a combined system of an electrodynamic suspension and transverse stabilization, comprising field coils arranged on the vehicle and common to suspension and stabilization, and inclined reactive buses mounted on the track bed parallel to the field coils (U.S. Pat. No. 3,768,417). In that combined system of an electrodynamic suspension and transverse stabilization, a levitation force is applied to the vehicle at an angle and comprises two components: a vertical one providing electrodynamic suspension and a horizontal one directed transversely to the vehicle and providing vehicle stabilization relative to the track axis.

It has been known to provide transportation devices in which a linear synchronous motor and an electrodynamic suspension are combined, which devices comprises an alternate pole system of field coils, mounted along the vehicle bottom, and a single-layer three-phase armature winding arranged horizontally along the track bed, active portions of the turns being formed as plates up to one third of the pole pitch in width. The active portions of the armature winding turns, formed as plates, are simultaneously employed as a reactive bus or conveyor for the electrodynamic suspension of the vehicle.

This combined arrangement is closest in its construction to the present invention.

However, transportation devices with an electrodynamic suspension, in which the systems of a linear synchronous motor and transverse stabilization, of an electrodynamic suspension and transverse stabilization, or a linear synchronous motor and an electrodynamic suspension are combined, do not provide complete combination of all three systems, for it is only some two systems that are combined. Hence, it is required to mount component parts of two different systems on the track bed and on the vehicle, which complicates the construction and assembling of transportation devices and reduces their operating reliability.

Furthermore, in transportation devices with an electrodynamic suspension and linear synchronous motors, in which the systems of a linear synchronous motor are combined with the systems of stabilization or suspension, there is a great number of electrical connections between active elements of the armature winding. A great number of electrical connections complicates assembling of the device and reduces its operational reliability.

SUMMARY OF THE INVENTION

It is an object of the present invention to provide a transportation device with an electrodynamic suspension, which is simple in design and easy to assemble.

Another object of the present invention is to provide a transportation device having an increased operational reliability by reducing a number of component elements and a number of electrical connections.

With these and other objects in view, there is provided a transportation device with an electrodynamic suspension, comprising a motor system, a suspension system, and a transverse stabilization system, the systems being provided with field coils mounted on a vehicle, and reactive buses of transverse stabilization, mounted along a track bed, and a three-phase armature winding horizontally mounted along the track bed and including turns having active portions formed as plates having a width of up to one third of the armature winding pole pitch, and including end portions, wherein, according to the invention, the end portions of the three-phase armature winding are formed in two layers and made in the form of rectangular plates mounted in parallel with the track axis, at least one layer of the end portions being parallel to the field coils of transverse stabilization, and the end portions being used as the reactive buses.

Making the three-phase armature winding with two-layer end portions provides uniform length destribution of the plates of the end portions in the form of two layers with small clearances between separate plates, and enables the end portions to be used as the reactive buses of the system of transverse stabilization, thus providing a reliable stabilization of the vehicle in the transverse direction.

Making the plates of the end portions rectangular and mounting them in parallel with the track axis provide straight reactive buses or conveyors arranged along the track bed and formed by the plates of the end portions.

Combining the functions of the armature winding and reactive buses of transverse stabilization in the same elements of the track structure permits maximum simplification of the track structure due to integration of the armature winding of the linear synchronous motor with the reactive buses of the electrodynamic suspension and transverse stabilization.

Mounting at least one layer of the end portions parallel to the field coils of transverse stabilization is required to provide equal in magnitude but opposite directed forces of interaction between the induced current flowing in the plates of the end portions and the oppositely directed currents in the lateral sides of the field coils of transverse stabilization. If the second layer of the end portions therewith does not serve as a reactive bus of transverse stabilization, it must be mounted at such a distance from the field coils of transverse stabilization that electromagnetic interaction between the armature winding current in that layer and the field coils of transverse stabilization may be neglected.

It is advisable to arrange the end portions of the three-phase armature winding in parallel planes.

The arrangement of the armature winding end portions in parallel planes provides electromagnetic interaction of the field windings of transverse stabilization with both layers of the armature winding end portions, which results in an increase of the interaction force between the field coils and end portions and in improvement of stabilization rigidity.

The end portions of the three-phase armature winding may be inclined relative to the track bed.

Such construction of the end portions results in production of the electromagnetic interaction forces directed transversely at an angle to the track bed. Said electromagnetic forces can be resolved into a vertical component encouraging an increase of levitation forces and a horizontal component providing transverse stabilization of the vehicle.

The end portions of the three-phase armature winding may be inclined at an angle approximately equal to 90 degrees with respect to the track bed.

Inclination of the end portions at an angle approximately equal to 90 degrees with respect to the track bed provides maximum of the force of transverse stabilization of the vehicle.

The field coils of transverse stabilization may be mounted on the side of like surfaces of the end portions.

Mounting the field coils of transverse stabilization on the side of the like surfaces of the end portions provides the least number of field coils employed for stabilization, fastening of the end portions to the track bed and mechanized snow removal therewith being facilitated, if the exciting coils are mounted on the side of outer surfaces of the armature winding end portions. If the field coils are mounted on the side of inner surfaces, it simplifies the vehicle construction and reduces its dimensions. According to the requirements imposed upon the transportion device, one may choose one of these versions of mounting the field coils relative to the armature winding end portions.

The field coils of transverse stabilization may be also mounted so as to surround the armature winding end portions on both sides thereof symmetrically, and the field coils therewith should be connected in opposition.

The opposition of the field coils and mounting the armature winding end portions in the plane of symmetry of these coils provide absence of the magnetic flux traversing the end portions. Such electrodynamic system is termed a zero flux system.

With this mutual arrangement of the field coils and end portions, electromagnetic interaction therebetween is eliminated, and hence, the vehicle being on the track axis, decelerating forces are not produced. Such mutual arrangement of the field coils and end portions is possible only when the layers of the end portions are in maximum proximity to each other, and the distance between the field coils surrounding the end portions exceeds the distance between the layers of the armature winding end portions at least ten times.

It is advisable that the field coils of transverse stabilization should symmetrically surround only the upper layers of the armature winding end portions. For example, when the distance between the layers of the end portions is sufficiently large, with the field coils of transverse stabilization being mounted symmetrically relative to the outer surfaces of both layers of the end portions, these layers of the end portions may be found at such a distance from the neutral plane of the field coil magnetic fields that eddy currents will be constantly induced in the end portions, which will reduce the rigidity of vehicle transverse stabilization and cause parasitic decelerating forces as the vehicle moves straightforward.

In these cases, the use of only the upper layer of the end portions as a reactive bus and its symmetric mounting between the field coils of transverse stabilization eliminate the parasitic decelerating forces and increase the rigidity of vehicle transverse stabilization.

It is advisable to mount, in addition to two field coils of transverse stabilization, mounted symmetrically relative to the outer surfaces of both layers of the end portions, additional field coils between the layers of the end portions in the plane of symmetry thereof and, the end coils therewith must be connected in opposition to the middle coil and mounted at such a distance therefrom that the end portions are found in the neutral plane of the magnetic field of the adjacent coils.

Mounting the additional field coils between the layers of the end portions in the plane of symmetry thereof and connecting the last coils in opposition to the middle one cause an increase of the stabilizing force.

Mounting the end field coils at such a distance from the middle one that the end portions are found in the neutral plane of the magnetic field of the opposite connected field coils, makes it possible to form a double zero flux system, which prevents the production of decelerating forces as the vehicle moves straightforward, and increases the rigidity of its transverse stabilization.

It is possible to make openings in the end portions of the three-phase armature winding, which are used to form short circuits. The openings must be located within the zones of projections of lateral sides of the field coils on the track bed at such a distance from the track axis that a total flux linkage, produced by the interaction of the field coil field with the short circuits formed by means of the openings provided in the end portions, is equal to zero.

Making the openings which are used to form the short circuits, in the armature winding end portions within the zones of projections of lateral sides of the field coils on the track bed provides location of the short circuits within the area of change in the direction of the normal component of the field coil magnetic flux, i.e., at the intersections of the curve of the normal component of the field coil magnetic induction with the zero abscissa axis.

With this arrangement of the short circuits, each of them is traversed by the field coil magnetic fluxes directed upwards and downwards simultaneously. When the vehicle is symmetric relative to the track axis, the sum of the magnetic fluxes traversing the circuit upwards and downwards is equal to zero, the short circuit axis therewith being not coincident with the intersection of the curve of the normal component of the field coil magnetic induction with the zero axis of abscissas (a zero point of the magnetic induction normal component), since the curve of the magnetic induction normal component is assymmetrical with respect to the zero point, and, as known, the short circuit is symmetric relative to its own axis.

The distance of the track axis to the zero point of the magnetic induction normal component is chiefly determined by two values: firstly, by the distance between the field coils and the short circuits, i.e., by the clearance of the vehicle levitation (flight), and secondly, by the shape and number of field coil turns. Furthermore, that distance to a lesser extent depends on other secondary factors: availability of a screen between the field coils and the vehicle passenger compartment, magnetic permeability of vehicle and track materials, and their homogeneity, etc.

For currently used levitation clearances with electrodynamic suspension in the range of 10 to 30 cm, and for various field coil shapes, the zero point of the magnetic induction normal component may deviate from the section vertical axes of the lateral sides of the field coils at a magnitude of 3 to 5 cm, yet remaining within the zone of projections of the lateral sides of the field coils on the track bed.

The amount of current excited in the short circuits, as the vehicle moves, is determined by the difference of the downwards and upwards directed field coil magnetic fluxes traversing these circuits. With the total flux produced, current is generated in the short circuit. Interaction of this current with the field coil field causes an electromagnetic interaction force directed towards the vehicle. When the total flux is equal to zero, current is not induced in the short circuit, and, hence, the electromagnetic interaction force is also equal to zero. It should be noted that current in the short circuit is determined not only by the field coil field, within the zone of projection of which this circuit is disposed, but also by the fields of the other adjacent field coils, i.e. by the total flux linkage of the circuit with all the field coils.

Making the openings in the end portions of the three-phase armature winding at such a distance from the track axis that the total flux linkage of the field coil field with the short circuits formed by the openings in the end portions is equal to zero, provides absence of stabilizing and decelerating forces, as the vehicle travels along the track without deviations from its axis, and production of stabilizing forces, as the vehicle deviates from the track axis, which brings the vehicle back to the track axis.

It is advisable that the openings in the end portions of the three-phase armature winding should be formed rectangular. Such a shape of the openings provides complete absence of current in the shorted circuits formed by these openings when the total flux linkage of each circuit with all the field coils is equal to zero. The authors found that, when short circuits of a variable width are used (such as of a circular or oval shape), varying the distance between the axes of the track and the short circuits, it is impossible to obtain a position of the short circuits on the track bed such that the sum of the magnetic fluxes directed upwards and downwards through each circuit are completely equal to zero.

This results from the fact that, as mentioned hereinabove, to provide the current in the circuit equal to zero, it is necessary to mount that circuit so that there are different distances between its axis and the zero point according to the width of the short circuit. When a circuit of a variable width is used, these distances will be different for a variety of sections of the circuit. As a result, it is impossible to select a distance from the track axis to the axis of the short circuit of a variable width such that the total flux linkage of this circuit with all the field coils should be exactly equal to zero, and, consequently, electric currents are not induced in the circuit at all, and electromagnetic forces of interaction with the field coils are not produced. It is only possible to select a distance of the track axis to the short circuit axis such that a minimum current is induced therein.

Since, with the decrease of minimum value of the current in the short circuit, sensitivity of the arrangement for transverse stabilization is increased, the use of a short circuit of a rectangular shape is the most advisable.

One layer of the end portions with the openings made therein may be displaced with respect to the other layer of the end portions in the direction perpendicular to the track axis.

The displacement of one layer of the end portions with respect to the other layer makes it possible to use an additional area formed by this displacement as additional reactive buses or conveyors of levitation system, an extra metal being not required to form these additional reactive buses.

To ensure that the openings in the armature winding end portions, with the end portion layers displaced with respect to each other, are located within the zones of projections of lateral sides of the field coils on the track bed, it is required that the width of these openings be considerably smaller than that of the end portions, a maximum allowable width of the additional reactive buses of the levitation system being proportional to the distance between the openings in the armature winding end portions and the spaced out sides of these end portions.

The amount of displacement of one layer of the armature winding end portions relative to the other one may exceed the width of the end portion plates, and the openings in the end portions therewith must be formed only in one layer.

The displacement of one layer of the end portions in excess of the width of the end portion plates provides utilization of all the areas of the end portion plates as reactive buses or conveyors. In doing so, the openings must be formed only in one layer of the end portions, since the layers of the end portions in that case do not overlap each other, and the openings in the end portions must be located within the zones of projections of lateral sides of the field coils of transverse stabilization on the track bed.

It is advisable to make each of four end portions and four active portions of the armature winding turns of solid material.

Making a few active portions and end portions of the turns as similar armature winding elements of solid material reduces the number of electrical connections of the three-phase armature winding, formed in its assembling on the track bed, thus facilitating assembly and increasing the operating reliability.

It should be noted that the similar elements of the armature winding may include no more than four active portions and four end portions to provide for assembly of the three-phase single-layer armature winding with double-layer end portions by means of such elements by sequential superimposition of the turns of each phase.

The proposed transportation device with an electrodynamic suspension and linear synchronous motors has an extremely simple track structure requiring less expenses in its manufacture and assembly and having a higher operating reliability, as compared to other transportation devices of that kind.

The aforementioned and other objects and advantages of the proposed invention will become more apparent upon consideration of the following detailed description of its preferred embodiments taken in conjunction with the accompanying drawings in which:

BRIEF DESCRIPTION OF THE ACCOMPANYING DRAWINGS

DETAILED DESCRIPTION OF THE INVENTION

Figure 1:
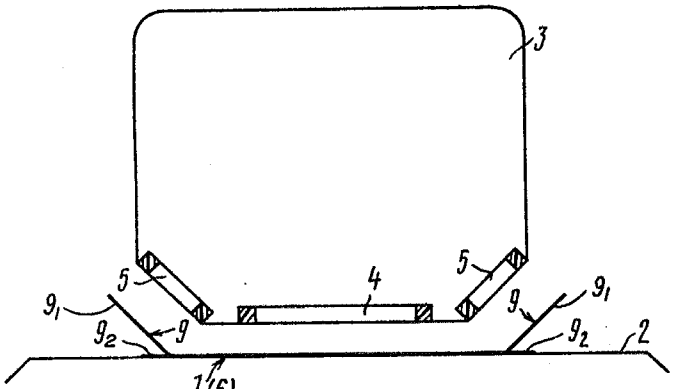
FIG. 1 is a schematic cross sectional view of a transportation device and mutual arrangement of an field coil and armature winding, according to the invention.

Referring now to the accompanying drawings and initially to FIG. 1, the transportation device with an electrodynamic suspension and a linear synchronous motor comprises a track structure 1 (FIG. 1) arranged on a track bed 2 and a vehicle 3 disposed above the track structure I and arranged symmetrically with respect to the longitudinal axis thereof.

Arranged on the vehicle 3 along the bottom thereof are field coils 4 of a linear synchronous motor and of a suspension of the vehicle 3, and field coils 5 of transverse stabilization of the vehicle 3. The windings of the field coils 4 and 5 are made of superconductive material, specifically of the NbTi (Niobium Titanium) alloy. It is also possible to make the windings of the field coils 4 and 5 of other superconductive materials such as $Nb_3Sn$ Niobium Tin, NbZr Niobium-Zirconium, etc. The field coils 4 of the linear synchronous motor and of the electrodynamic suspension of the vehicle 3 are mounted parallel to the track bed 2, and the field coils 5 for transverse stabilization of the vehicle are mounted at an angle in the transverse direction to the track bed 2. The field coils 4 and 5 are secured inside a thermally insulated cryostat (not shown in the drawing) and cooled by liquid helium. The field coils 4 and 5 are energized with direct current.

Figure 3:
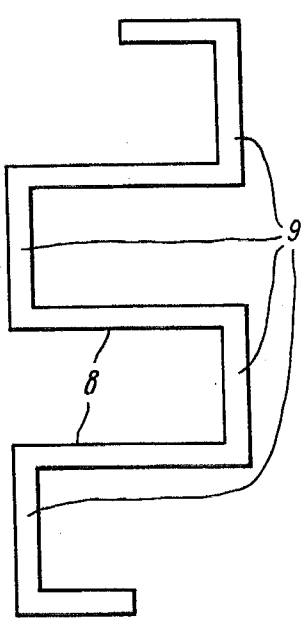
FIG. 3 is a view of a phase element of the armature winding, according to the invention.
Figure 2:
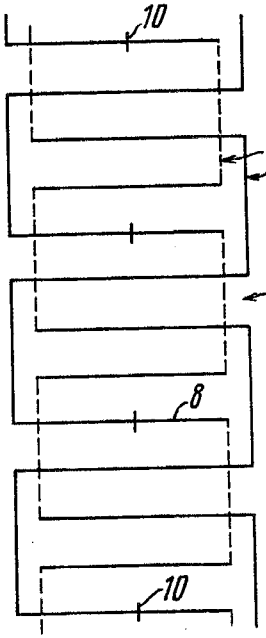
FIG. 2 is a diagrammatic representation of a three-phase armature winding, according to the invention.

The track structure 1 represents a three-phase armature winding 6 (FIG. 2) made according to the diagram of a single-layer wave winding with double-plane end portions. Each phase of the armature winding 6 consists of similar elements 7 (FIG. 3) fabricated by stamping. The elements 7 are made of highly conductive material, specifically an aluminium sheet. It is also possible to make the elements 7 of other highly conductive materials, such as copper, brass, bronze, etc.

Making a few active portions and end portions of the turns as similar armature winding elements of solid material reduces the number of electrical connections of the three-phase armature winding, formed when assembling the armature winding on the track bed, thus facilitating the assembly and increasing the device operational reliability.

It should be noted that the similar elements of the armature winding may include no more than four active portions and four end portions to provide for assembly of the three-phase armature winding with double-layer end portions by means of said elements, by sequential superimposition of the turns of each phase.

The elements 7 contain four active portions 8 formed as plates and four end portions 9 also formed as plates. Ends 10 (FIG. 2) of the elements 7 of the same phase are interconnected by welding (not shown). Other connections of the elements of the same phase such as bolting, soldering, etc. are also possible.

The width of the plates of the active portions 8 is smaller than $\frac{1}{3}$ of the pole pitch of the armature winding 6. The end portions 9 are formed in two layers. The upper layers $9_1$ of the end portions 9 (FIG. 1) are mounted parallel to the field coils 5 of transverse stabilization, and the lower layers $9_2$ of the end portions 9 are arranged horizontally on the track bed 2. In that embodiment of the transportation device, only the upper layers $9_1$ of the end portions 9 act as reactive buses or conveyors for the suspension and transverse stabilization.

The field coils 4 taken in conjunction with the three-phase armature winding 6 (FIG. 2) make up a motor system, and the field coils 4 (FIG. 1) and the elements 7 (FIG. 3) make up a suspension system, while the field coils 5 (FIG. 1) used in combination with the end portions 9 make up a transverse stabilization system.

Figure 4:
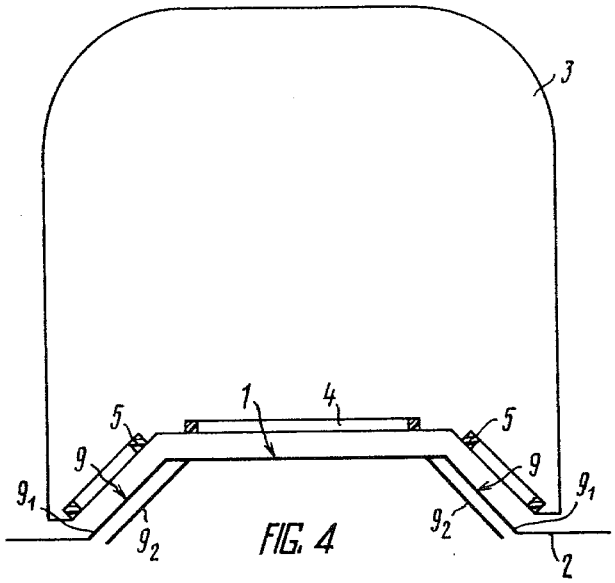
FIG. 4 is a cross sectional view of a transportation device with one-sided arrangement of the field coils of transverse stabilization with respect to the armature winding end portions, according to the invention.

FIG. 4 shows the embodiment of the transportation device with an electrodynamic suspension, in which both the upper and the lower layers $9_1$ and $9_2$, respectively, of the end portions 9 are mounted parallel to the field coils 5 of transverse stabilization.

There are possible embodiments of the device, in which the end portions 9 (FIGS. 5 to 9) of the armature winding 6 are normal to the horizontal surface of the track bed 2.

Such an embodiment provides for maximization of the force of transverse stabilization.

The field coils 5 of transverse stabilization in these cases are mounted vertically on the vehicle 3.

In one embodiment, the field coils 5 are mounted on the outside of the end portions 9 (FIG. 5), and in another embodiment, the field coils 5 (FIG. 6) are mounted on the inside of the end portions 9.

There is a possible embodiment in which two field coils 5 (FIG. 7) surround symmetrically both layers of the end portions 9, the field coils 5 being connected in opposition. The opposite connection of the field coils 5 as well as the arrangement of the end portions 9 of the armature winding 6 in the plane of symmetry of said coils leads to the absence of the magnetic flux traversing the end portions 9.

In another embodiment, the field coils 5 (FIG. 8) surround symmetrically the upper layer $9_1$ of the end portions, are connected in opposition, and are mounted at a distance therebetween which is smaller than in the previous embodiment. This results from the fact that one layer of the end portions 9 may be positioned exactly in the neutral plane of the magnetic fluxes of the two field coils 5. The lower layer $9_2$ of the end portions 9 is bent downwards and does not participate in transverse stabilization of the vehicle, its width being smaller than that of the upper layer $9_1$.

There is still another embodiment of the transportation device, in which the end portions 9 (FIG. 9) are symmetrically surrounded by two field coils 5 of transverse stabilization on either side thereof, and furthermore, the additional field coils $5_1$ are mounted between the layers of the end portions 9 in the plane of their symmetry. The field coils 5 surrounding the end portions 9 are connected in agreement and the middle coil $5_1$ is connected in opposition thereto, the end portions 9 being disposed in the neutral plane of the magnetic field of the adjacent coils $5_2$ and $5_3$.

Figure 10:
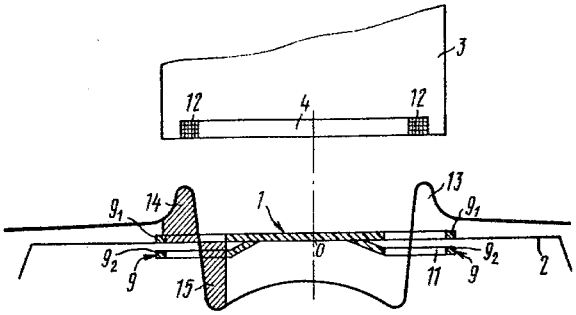
FIG. 10 is a schematic cross sectional view of mutual arrangement of the field coils mounted on the vehicle and short circuits disposed on the track bed, and also a curve of distribution of the magnetic induction normal component of the field coil along the width of the track at the bed level thereof, according to the invention.
Figure 11:
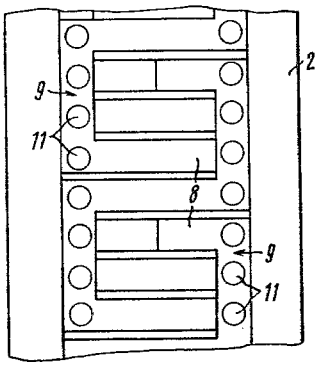
FIG. 11 is a view of a track structure of the transportation device with openings provided in the end portions of the three-phase armature winding, according to the invention.

There is another embodiment of the track structure 1 (FIGS. 10 and 11) in which the end portions 9 are disposed in a horizontal plane. Circular openings 11 are formed in both layers $9_1$ and $9_2$ of the end portions 9 and disposed within the zones of projections of lateral sides 12 of the field coils 4 which act in the same manner as the field coils 5 of transverse stabilization. An exact location of the openings 11 in the upper layer $9_1$ of the end portions 9 with respect to the axis of the track bed 2 is determined by a curve 13 of distribution of the magnetic induction normal component of the field coil 4 over the track width at the level of location of the upper layer $9_1$ of the end portions 9. These openings are arranged at such a distance from the track axis that an area 14 characterizing the magnitude of the upwards directed magnetic flux is equal to an area 15 characterizing the magnitude of the downwards directed magnetic flux, the fluxes traversing every opening 11. In this case, a total flux linkage produced by the interaction of the field of the field coils 5 with short circuits formed by means of the openings 11 provided in the end portions 9 is equal to zero.

An exact location of the openings 11 in the lower layer $9_2$ of the end portions 9 with respect to the axis of the track bed 2 is determined by a curve (not shown) of distribution of the magnitude of the magnetic induction normal component of the field coil 4 over the track width at the level of location of the lower layer $9_2$ of the end portions 9 on the track bed 2. The distance from the track axis to the openings 11 in the lower layer $9_2$ of the end portions 9 is chosen so as to obtain magnitudes of the magnetic fluxes directed upwards and downwards through the openings 11 which are equal to each other.

Figure 12:
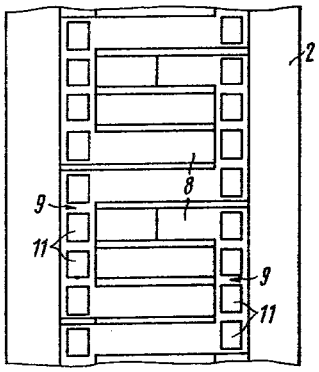
FIG. 12 is another embodiment of the openings provided in the end portions of the three-phase armature winding, according to the invention.

Another version of making the openings 11 in the end portions 9 of the armature winding 6 is shown in FIG. 12 in which similar elements are indicated by the same reference numerals. In that version the openings 11 are formed in a rectangular shape.

Figure 13:
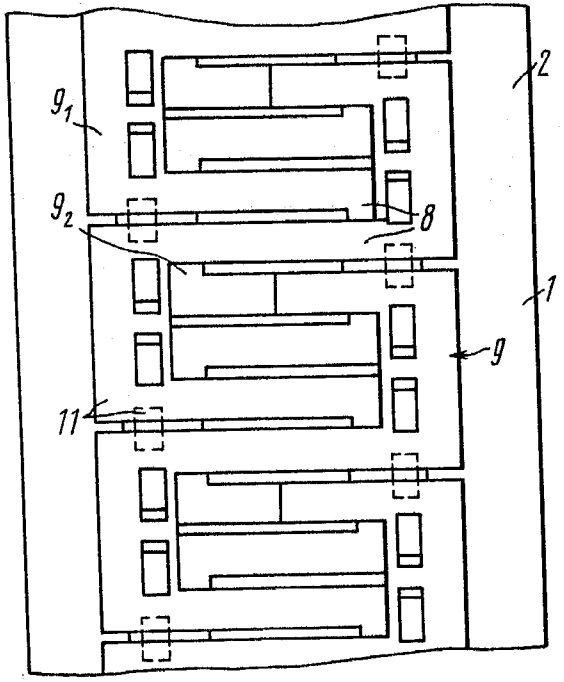
FIG. 13 is another embodiment of the track structure of the transportation device with openings provided in the end portions of the three-phase armature winding, according to the invention.

In another embodiment of the track structure the lower layer $9_2$ of the end portions 9 (FIG. 13) of the armature winding 6 is displaced in the transverse direction relative to the upper layer $9_1$, but in doing so, the openings 11 formed in both layers $9_1$ and $9_2$ of the end portions 9 remain one above the other within the zones of projections of the lateral sides 12 of the field coils 4 (FIG. 10), and their exact location in the end portions 9 is defined by the condition of absence of the total magnetic flux through the openings 11.

Figure 14:
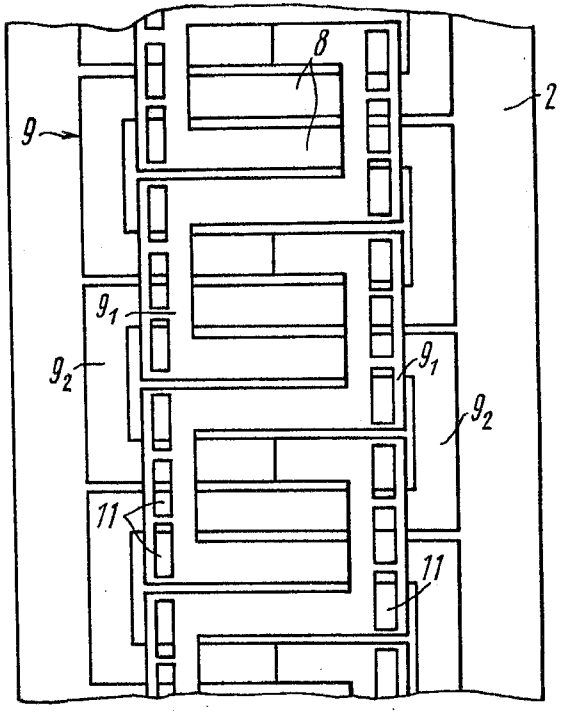
FIG. 14 is still another embodiment of the track structure of the transportation device with openings provided in the end portions of the three-phase armature winding.

Still another embodiment of the track structure 1 is shown in FIG. 14. In that embodiment of the track structure, the lower layer $9_2$ of the end portions 9 is displaced relative to the plates of the upper layer $9_1$ of the end portions 9 at a distance exceeding the width of the plates, and the openings 11 are formed only in the upper layer $9_1$ of the end portions 9.

The proposed transportation device with an electrodynamic suspension operates as follows.

Interaction of the magnetic field of the field coils 4 of the linear synchronous motor, mounted on the vehicle 3; with variable frequency current supplied to the armature winding 6, provides a required propulsive force.

As the speed of the vehicle 3 increases, the magnetic fields of the field coils 4 of the linear synchronous motor and electrodynamic suspension, and of the field coils 5 of transverse stabilization, induce eddy currents in the plates of the active portions 8 and end portions 9 of the armature winding 6, arranged along the track bed 2. Interaction forces between the magnetic fields of the field coils 4 of the linear synchronous motor and the eddy currents in the plates of the active portions 8 of the armature winding are directed upwards, and electromagnetic interaction forces between the field coils 5 of transverse stabilization and the eddy currents in the plates of the end portions 9 are directed at an angle to the vehicle with respect to the track bed 2 and may be resolved into a vertical component and a horizontal one. The horizontal component is applied to the vehicle 3 in the transverse direction and is intended to stabilize vehicle movement. With a vehicle speed of 50 to 80 kms/hr, the electromagnetic interaction force applied to the vehicle 3 in the vertical direction starts to lift the vehicle 3, and with a travelling speed it moves at a predetermined levitation clearance above the track bed 2. The levitation clearance is determined by current intensity and the number of turns in the field coils 4 and 5, and by electric conductivity and dimensions of the reactive buses or conveyors.

With deviations of the vehicle 3 from the track axis, as the field coils 5 of transverse stabilization mounted on the vehicle at an inclination approach the end portions 9 mounted parallel thereto on the track bed 2 (FIGS. 1 and 4 to 6), the oppositely directed transverse components of electromagnetic interaction forces are sharply increased, bringing the vehicle back into a position symmetric to the track axis.

In the embodiments of the transportation device with an electrodynamic suspension and a linear synchronous motor, shown in FIGS. 5 to 9, in which the end portions 9 are rotated through 90 degrees relative to the longitudinal axis, the electromagnetic interaction forces between the field coils 5 of transverse stabilization and the end portions 9 of the armature winding 6 are disposed in a plane parallel to the track bed 2 and do not participate in production of the levitation force.

Figure 5:
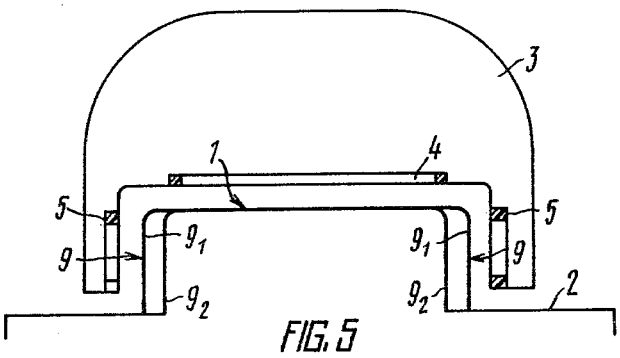
FIG. 5 is a cross sectional view of another embodiment of a transportation device with one-sided arrangement of the field coils of transverse stabilization with respect to the armature winding end portions, according to the invention.
Figure 6:
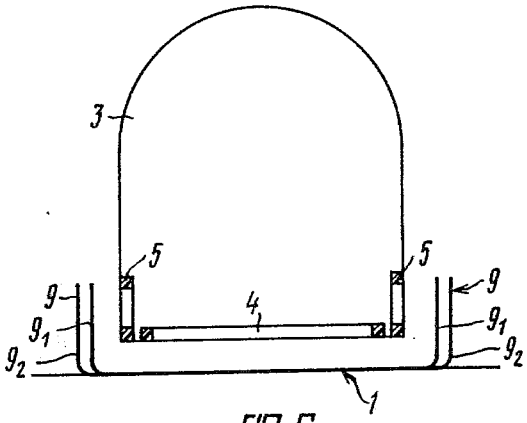
FIG. 6 is a cross sectional view of still another embodiment of a transportation device with one-sided arrangement of the field coils of transverse stabilization with respect to the armature winding end portions, according to the invention.

In the embodiments of the transportation device, shown in FIGS. 5 and 6, as the vehicle 3 moves, these electromagnetic interaction forces as the vehicle 3 moves, act constantly, and transverse stabilization of the vehicle 3 is performed due to a sharp increase of repulsive forces between the field coils 5 of transverse stabilization and the end portions 9 as they are brought closer together when the vehicle 3 deviates from the track axis.

Figure 7:
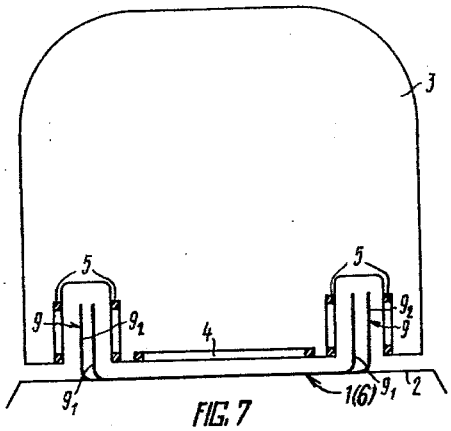
FIG. 7 is a cross sectional view of yet another embodiment of a transportation device with two-sided arrangement of the field coils of transverse stabilization with respect to the armature winding end portions, according to the invention.
Figure 8:
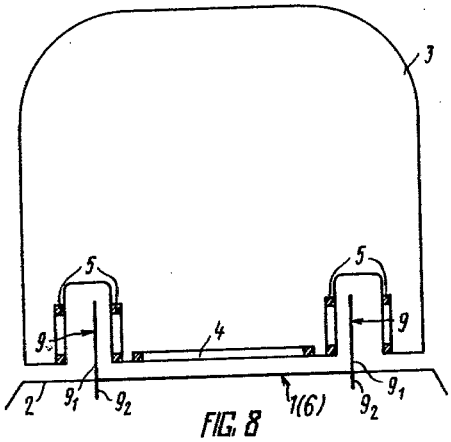
FIG. 8 is a cross sectional view of a further embodiment of a transportation device with two-sided arrangement of the field coils of transverse stabilization with respect to the upper layer of the armature winding end portions, according to the invention.
Figure 9:
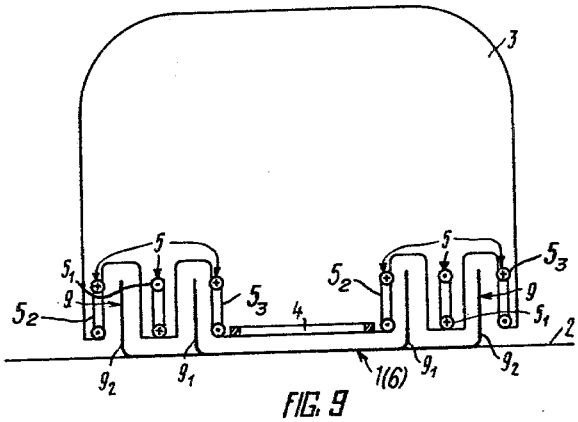
FIG. 9 is a cross sectional view of a transportation device with three field coils of transverse stabilization on either side of the vehicle, according to the invention.

In the embodiments of the transportation device with an electrodynamic suspension and a linear synchronous motor, shown in FIGS. 7 to 9, in which transverse stabilization of the vehicle 3 is performed according to a zero flux scheme, as the vehicle 3 moves straight along the track axis, eddy currents in the end portions 9 of the armature winding 6 are not induced practically since the end portions 9 are located in the neutral field of the oppositely connected field coils 5. Upon deviation of the vehicle 3 from the track axis, the end portions 9 move away from the neutral field of the oppositely connected field coils 5 and eddy currents are induced in the plates of the end portions 9. Interaction of the eddy currents with the field of the field coils produces a repulsive force which brings the vehicle 3 back into a position symmetric with respect to the track axis.

When the reactive buses or conveyors of transverse stabilization are implemented by the end portions 9 (FIG. 10) with the openings 11 being used to form the short circuits, the transportation device operates as follows.

As the vehicle moves along the track axis, the magnetic field of the field coils 5, which have a distribution of the magnetic induction normal component over the track width characterized by the curve 13, induces a total emf in the short circuits formed by the circular openings 11, which total emf is close to zero. In that case the area 14 characterizing the magnitude of the magnetic flux directed upwards is very close to the area 15 characterizing the magnitude of the magnetic flux directed downwards, which fluxes traverse each circuit. With the openings 11 forming the short circuits being made rectangular in the end portions 9, when the vehicle 3 is on the track axis, the areas 14 and 15 are equal and the forces of electromagnetic interaction of the field coils 5 with each short circuit are not produced.

When the vehicle 3 deviates from the track axis, the field coils 5 are displaced in the transverse direction with respect to the short circuits formed by means of the openings 11, the areas 14 and 15 becoming unequal, as a result of which the total magnetic flux traversing the short circuits is produced. The resultant magnetic flux induces in the short circuits an emf, thus causing current to flow therein. Interaction of the current in the short circuits with the magnetic field of the field coils 5 causes stabilizing forces which bring the vehicle 3 back to the track axis.

When the upper and lower layers $9_1$ and $9_2$ of the end portions are spaced from each other (FIGS. 13 and 14), the field coils 4 of the linear synchronous motor and electrodynamic suspension, mounted on the vehicle 3, induce eddy currents not only in the plates of the active portions 8 and end portions 9 of the upper layer, but also in the plates of the end portions 9 of the lower layer pulled out from under the upper one. Interaction forces between the magnetic fields of the field coils 4 of the linear synchronous motor and the eddy currents in the plates of the end portions 9 of the lower layer represent additional forces improving levitation.

While particular embodiments of the present invention have been shown and described, various modifications thereof will be apparent to those skilled in the art, and therefore it is not intended that the invention be limited to the disclosed embodiments or to the details thereof, and departures may be made therefrom within the spirit and scope of the present invention as set forth in the appended claims.

What is claimed is:

1. A transportation device with an electrodynamic suspension, comprising a vehicle adapted for moving along a track bed having a track axis, field coils of a motor, field coils of a suspension, and field coils of transverse stabilization, said coils being each mounted on said vehicle, and a three-phase winding mounted horizontally along said track bed and including active portions of turns formed as plates having a width of up to one-third of the pole pitch of said three-phase winding, and end portions comprising rectangular plates formed in two layers and arranged in parallel with the track axis, at least one layer of said end portions being mounted parallel to said field coils of transverse stabilization, said three-phase winding and said field coils of said motor forming a linear synchronous motor, and said end portions being used as reactive buses for transverse stabilization of said transportation device.

2. A transportation device as claimed in claim 1, wherein said end portions of said three-phase winding are disposed in parallel planes.

3. A transportation device as claimed in claim 1, wherein said end portions of said three-phase winding are inclined with respect to said track bed.

4. A transportation device as claimed in claim 3, wherein the angle of inclination of said end portions of said three-phase winding is approximately equal to 90 degrees.

5. A transportation device as claimed in claim 1, wherein said field coils of transverse stabilization are mounted on the side of like surfaces of said end portions.

6. A transportation device as claimed in claim 1, wherein said end portions are symmetrically surrounded on both sides thereof by said field coils of transverse stabilization connected in opposition.

7. A transportation device as claimed in claim 6, wherein said upper layer of said end portions is symmetrically surrounded on both sides thereof by said field coils of transverse stabilization.

8. A transportation device as claimed in claim 6, wherein additional field coils of transverse stabilization are mounted between said layers of said end portions in a plane of symmetry thereof, said additional field coils being connected in opposition to said field coils surrounding said end portions and being spaced at such a distance therefrom that said end portions are disposed in a neutral plane of a magnetic field produced by adjacent said field and said additional field coils.

9. A transportation device as claimed in claim 1, further including short circuits disposed along said track bed and formed by means of openings made in said end portions of said three-phase winding, said short circuits being disposed within zones of projections of lateral sides of said field coils on said track bed and being spaced at such a distance from the track axis that a total flux linkage produced by interaction of the magnetic field of said field coils with said short circuits formed by means of said openings in said end portions is equal to zero.

10. A transportation device as claimed in claim 9, wherein said openings in said end portions are rectangular.

11. A transportation device as claimed in claim 9, wherein one of said two layers of said end portions is displaced with respect to another of said two layers of said end portions in a direction perpendicular to the track axis.

12. A transportation device as claimed in claim 11, wherein displacement of one layer of said end portions with respect to the other layer of said end portions exceeds the width of said rectangular plates of said end portions, said openings being made only in one layer of said end portions.

13. A transportation device as claimed in claim 1, wherein each four of said end portions and four of said active portions of the turns of said winding are made of solid material.

* * * * *